US010947082B2

(12) United States Patent
Hagl et al.

(10) Patent No.: US 10,947,082 B2
(45) Date of Patent: Mar. 16, 2021

(54) WINDING STATION HAVING A MOVABLE COVER UNIT

(71) Applicant: Rieter Ingolstadt GmbH, Ingolstadt (DE)

(72) Inventors: Robert Hagl, Rottenegg (DE); Thomas Gruber, Ingolstadt (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 160 days.

(21) Appl. No.: 16/316,794

(22) PCT Filed: Jul. 4, 2017

(86) PCT No.: PCT/EP2017/066540
§ 371 (c)(1),
(2) Date: Jan. 10, 2019

(87) PCT Pub. No.: WO2018/011002
PCT Pub. Date: Jan. 18, 2018

(65) Prior Publication Data

US 2020/0180901 A1 Jun. 11, 2020

(30) Foreign Application Priority Data

Jul. 11, 2016 (DE) ..... 10 2016 112 641.1

(51) Int. Cl.
*B65H 54/72* (2006.01)
*B65H 54/26* (2006.01)
(Continued)

(52) U.S. Cl.
CPC ..... *B65H 54/72* (2013.01); *B65H 54/26* (2013.01); *B65H 67/085* (2013.01); *B65H 63/00* (2013.01); *B65H 2701/31* (2013.01); *D01H 4/48* (2013.01)

(58) Field of Classification Search
CPC .. D01H 1/16; D01H 4/22; D01H 9/02; D01H 9/04; D01H 11/00; D01H 4/48;
(Continued)

(56) References Cited

U.S. PATENT DOCUMENTS 2,132,698 A * 10/1938 Price ..... B65H 54/103 242/482.8
3,807,157 A * 4/1974 Stahlecker ..... G01L 1/225 57/406
(Continued)

FOREIGN PATENT DOCUMENTS

CN 1120084 A 4/1996
CN 103 964 260 A 8/2014
(Continued)

OTHER PUBLICATIONS

German Patent Office Search Report, dated Feb. 17, 2017.
(Continued)

*Primary Examiner* — Shaun R Hurley
(74) *Attorney, Agent, or Firm* — Dority & Manning, P.A.

(57) ABSTRACT

A winding station of a textile machine for producing cross-wound bobbins includes a base unit, a cover unit, and a bobbin holder configured to hold the cross-wound bobbin. A traversing device is configured to lay a thread in a crosswise manner on the cross-wound bobbin. A thread finding device is configured to find a thread end on the cross-wound bobbin. The base unit at least partially covers the cover unit, and the cover unit is movable with respect to the base unit between a working position for laying the thread and seeking the thread end and a cleaning position for cleaning the winding station. At least portions of the thread finding device are configured on the cover unit. A method is also provided for operating the winding station.

15 Claims, 4 Drawing Sheets

(51) Int. Cl.
*B65H 67/08* (2006.01)
*B65H 63/00* (2006.01)
*D01H 4/48* (2006.01)

(58) Field of Classification Search
CPC ..... B65H 54/26; B65H 54/72; B65H 63/00; B65H 67/085; B65G 2701/31
See application file for complete search history.

(56) References Cited

U.S. PATENT DOCUMENTS

| | | | | | |
|---|---|---|---|---|---|
| 3,973,381 | A * | 8/1976 | Teranishi | D01H 1/16 | 57/58.83 |
| 4,107,911 | A * | 8/1978 | Yamana | D01H 1/115 | 57/304 |
| 4,125,990 | A * | 11/1978 | Stahlecker | B65H 67/04 | 242/473.7 |
| 4,638,955 | A * | 1/1987 | Schippers | B65H 54/22 | 242/473.8 |
| 4,736,898 | A * | 4/1988 | Raasch | B65H 54/34 | 242/475.7 |
| 5,426,929 | A | 6/1995 | Schwalm et al. | | |
| 5,553,799 | A * | 9/1996 | Todo | B65H 49/02 | 242/128 |
| 6,804,945 | B2 | 10/2004 | Straaten | | |
| 7,504,617 | B2 | 3/2009 | Peters et al. | | |
| 10,384,908 | B2 * | 8/2019 | Maleck | B65H 57/003 | |
| 2003/0029153 | A1 * | 2/2003 | Straaten | D01H 4/50 | 57/263 |
| 2003/0038206 | A1 | 2/2003 | Grecksch et al. | | |
| 2008/0203214 | A1 * | 8/2008 | Naulet | B65H 54/72 | 242/476.9 |
| 2013/0074468 | A1 * | 3/2013 | Guggemos | D01H 7/86 | 57/58.83 |

FOREIGN PATENT DOCUMENTS

| | | | | |
|---|---|---|---|---|
| CN | 203 903 680 | U | 10/2014 | |
| CN | 204896996 | U | 12/2015 | |
| CN | 105217377 | A | 1/2016 | |
| DE | 40 04 028 | A1 | 8/1991 | |
| DE | 101 39 074 | A1 | 2/2003 | |
| DE | 101 39 075 | A1 | 2/2003 | |
| DE | 10 2004 003 174 | A1 | 8/2005 | |
| DE | 10 2008 013 108 | A1 | 9/2009 | |
| DE | 102010049515 | A1 * | 4/2012 | B65H 67/081 |
| DE | 10 2012 016 854 | A1 | 2/2014 | |
| DE | 10 2014 009 203 | A1 | 12/2015 | |
| EP | 1 092 667 | A2 | 4/2001 | |
| EP | 1092667 | A2 * | 4/2001 | B65H 54/72 |
| EP | 0 818 410 | B1 | 11/2002 | |
| EP | 2 345 610 | A2 | 7/2011 | |
| EP | 2 444 347 | A2 | 4/2012 | |
| JP | S 59 31256 | A | 2/1984 | |
| JP | H 1160065 | A | 3/1999 | |
| JP | 2011-042449 | A | 3/2011 | |

OTHER PUBLICATIONS

PCT Search Report, dated Sep. 8, 2017.
IPRP, Jan. 15, 2019.
CN Examination Report, dated May 29, 2020.
Indian Patent Office Examination Report, dated Oct. 29, 2020.
CN Notice of Allowance, dated Nov. 5, 2020.
JPO Search Report, dated Dec. 23, 2020.
JPO Office Action, dated Jan. 6, 2021.

* cited by examiner

WINDING STATION HAVING A MOVABLE COVER UNIT

FIELD OF THE INVENTION

The present invention relates to a winding station of a textile machine producing cross-wound bobbins, consisting of a base unit and a cover unit, wherein the winding station includes a bobbin holder for holding a cross-wound bobbin and a traversing device for laying a thread in a crosswise manner on the cross-wound bobbin. A thread seeking device is provided in order to seek a thread end on the cross-wound bobbin.

Moreover, the invention relates to a method for operating a winding station of a textile machine producing cross-wound bobbins, wherein the winding station consists of a base unit and a cover unit, and wherein a thread is laid in a crosswise manner on the cross-wound bobbin with the aid of a traversing device. A thread end is sought, if necessary, on the cross-wound bobbin with the aid of a thread seeking device, and the winding station is cleaned at intervals of time.

BACKGROUND

Winding stations of textile machines producing cross-wound bobbins, wherein the winding station comprises a bobbin holder for holding a cross-wound bobbin and a traversing device for laying a thread in a crosswise manner on the cross-wound bobbin, are well known. The textile machine can be a winder or even a spinning machine, in particular a rotor spinning machine or an air-jet spinning machine.

It has also been well known for some time that a thread seeking device is provided in such winding stations in order to seek a thread end on the cross-wound bobbin. The thread end running onto the cross-wound bobbin occurs, in particular, after a thread break or a cleaning cut, or, for example, when the supply bobbin is empty. In a cleaning cut, the thread is intentionally severed because it does not have the desired properties, such as thickness or cleanliness. In such cases, the cross-wound bobbin cannot be stopped fast enough, due to its inertia, and so the thread end runs onto the cross-wound bobbin. In order to further wind the cross-wound bobbin, a new thread can now be pieced on the cross-wound bobbin. In this case, the thread is no longer continuous, however. In order to ensure that a continuous thread is nevertheless present on the cross-wound bobbin, the thread end which has run onto the cross-wound bobbin must be sought and found. Thereupon, in the case of a winder, the thread end is connected to a thread coming from a supply bobbin or, in the case of a spinning machine, the thread end is connected to the freshly spun thread or is pieced on a spinning assembly. In this way, the thread located on the cross-wound bobbin remains continuous.

A suction nozzle to which vacuum is applied and which sucks in the free thread end is frequently utilized as a thread seeking device. Thread seeking devices are also known, however, which wipe the thread end off of the surface of the cross-wound bobbin using brushes or which blow the thread end off of the surface of the cross-wound bobbin with the aid of compressed air.

The more components a winding station comprises, however, the more difficult it is to clean the winding station.

The problem addressed by the present invention is therefore that of designing a winding station including a thread seeking device, in the case of which cleaning is made easier.

SUMMARY OF THE INVENTION

The problem is solved using a winding station and a method for operating a winding station having the features described and claimed herein. Additional objects and advantages of the invention will be set forth in part in the following description, or may be obvious from the description, or may be learned through practice of the invention.

The invention provides a winding station of a textile machine producing cross-wound bobbins. The textile machine can be a winder or a spinning machine, in particular a rotor spinning machine or an air-jet spinning machine. The winding station consists of a base unit and a cover unit in this case. The winding station also includes a bobbin holder for holding a cross-wound bobbin and a traversing device for laying a thread in a crosswise manner on the cross-wound bobbin. These components are essential to the production of a cross-wound bobbin.

Moreover, a thread seeking device is provided for seeking a thread end on the cross-wound bobbin. A thread end runs onto the cross-wound bobbin, for example, after a thread break, a cleaning cut, or when a supply bobbin is empty. The cross-wound bobbin can generally not be stopped in a timely manner in order to prevent the thread end from running onto the cross-wound bobbin in this way. In order to obtain a continuous thread on the cross-wound bobbin—which is important for the further utilization of the cross-wound bobbin—the thread which has run onto the cross-wound bobbin must first be sought and found. This step is carried out by the thread seeking device. Thereupon, in the case of a winder, the thread end is connected to the thread coming from the supply bobbin or, in the case of a spinning machine, the thread end is connected to the freshly spun thread or is pieced onto a spinning assembly. In this way, a continuous thread is obtained.

According to the invention, the base unit is at least partially covered by the cover unit. The points of the base unit which are covered by the cover unit are exposed to flying dust and fiber fly to a considerably lesser extent in this case than are points which are not covered. Moreover, the cover unit is movable with respect to the base unit between a working position for laying the thread and seeking the thread end and a cleaning position for cleaning the winding station. At least some parts of the thread seeking device are assigned to the cover unit in this case. Due to the cleaning position, the operating personnel or a traveling cleaner or a robot including a cleaning unit is provided with access to various points of the winding station, which therefore simplifies and improves the cleaning overall. Due to the fact that at least some parts of the thread seeking device are assigned to the cover unit, these parts of the thread seeking device are also more easily accessed, which makes the cleaning easier.

Advantageously, the cover unit is displaceable, in particular, rotatably and/or linearly displaceable, with respect to the base unit between the working position and the cleaning position. These motions can be carried out easily and, simultaneously, robustly, which makes the operation of the winding station reliable. Moreover, rotational or displacement motions can also be easily carried out by a motor, which allows the automation of the cleaning process. It is also possible to completely remove the cover unit from the working position, for example, by loosening screws, and to bring the cover unit back into this working position and secure it by tightening the screws.

It is also advantageous when the thread seeking device includes a suction nozzle, to which vacuum can be applied and which includes a suction port. In order to search for the thread, a suction opening of the suction port is positioned a short distance away from the surface of the cross-wound bobbin. With the vacuum switched on, the cross-wound bobbin is rotated backward relative to the direction of rotation during winding. The free thread end is sucked into the suction port and further into the suction nozzle. Seeking a thread with the aid of a vacuum is one of the most gentle thread seeking methods, since the surface of the cross-wound bobbin is not touched. The surface of the cross-wound bobbin is therefore only very slightly or not at all damaged, which provides for a high quality of the cross-wound bobbin.

It is also advantageous when the suction port is movable with respect to the suction nozzle. In general, the distance from the suction port to the cross-wound bobbin should be changeable. As a result, a greater distance can be selected during the normal winding operation, and so the winding is not obstructed and any damage to the cross-wound bobbin by the suction port is avoided. In order to seek a thread, in turn, the suction port can be moved close to the surface of the cross-wound bobbin, and so the available vacuum is utilized in the best way possible. If the suction port is then movable with respect to the suction nozzle, the distance from the suction port to the cross-wound bobbin can be changed by moving a component which is relatively small as compared to the entire suction nozzle.

Moreover, it is advantageous when a drive means, in particular, a drive motor is provided for moving the suction port. In this way, the suction port can be automatically moved into the position for thread seeking and back again. This is particularly advantageous for an automated spinning position. Without such a drive means, the suction port would have to be brought into the desired position either by the operating personnel or a robot.

Advantageously, the suction port is rotatably and/or linearly displaceable with respect to the suction nozzle. With the aid of one or both of these motions, the suction port can be moved, easily and precisely, into the position for thread seeking, and back again. In addition, rotational and linear displacement motions can be carried out particularly well by the drive means.

It is also advantageous when a first portion of the suction nozzle is assigned to the base unit and a second portion is assigned to the suction nozzle of the cover unit. In this way, the two parts of the suction nozzle are separated from one another in the cleaning position, which makes it easier to access these parts and, therefore, clean the parts.

It is advantageous when the suction port is assigned to the first part or to the second part of the suction nozzle. In this way, the suction port is not divided in the cleaning position. As a result, edges and separating joints are also dispensed with, on which the found thread would otherwise rub, get caught, or become jammed. The thread is therefore handled in a more gentle manner, which benefits the quality of the product. In addition, the sequence of the thread seeking is less error-prone, whereby fewer interventions by the operating personnel or by robots are required and, consequently, the productivity of the textile machine is increased.

Advantageously, an interruption means is provided for interrupting the vacuum in the cleaning position of the cover unit. Since, in the cleaning position, no vacuum is required for seeking the thread, it is ensured by way of this interruption means that no vacuum is consumed during the cleaning.

It is also advantageous when a locking means is provided for locking the cover unit in its working position and/or cleaning position. In this way, an unintentional movement of the cover unit from one position into the other position is made difficult. In addition, the cover unit is then located in defined positions, which allows, in particular, for an exact position for the thread seeking, but also enables a cleaning assembly to clean in a precise manner. The locking means can be unlocked manually and/or automatically in this case.

The device is designed according to the preceding description, wherein the mentioned features can be present individually or in any combination.

Moreover, a method for operating a winding station of a textile machine producing cross-wound bobbins is provided. The winding station consists of a base unit and a cover unit in this case. A thread is laid in a crosswise manner on the cross-wound bobbin with the aid of a traversing device. If necessary, a thread end is sought on the cross-wound bobbin with the aid of a thread seeking device and the winding station is cleaned at intervals of time. There is a need to seek a thread when a thread end has run onto the cross-wound bobbin, for example, after a thread break, after a cleaning cut, or when the supply bobbin is empty. The cleaning of the winding station can take place at fixed or even variable intervals of time. The latter could always be, for example, when a traveling cleaner passes by the winding station or when the winding station reports a need for cleaning, for example, because a sensor establishes that there is a large amount of pollution.

According to the invention, in order to clean the winding station, the cover unit is moved with respect to the base unit out of a working position into a cleaning position, pollutant is removed from the winding station, and the cover unit is moved from the cleaning position back into the working position. Due to the movement of the cover unit into the cleaning position, access to certain parts of the winding station is made possible and, therefore, the cleaning of the winding station is made easier and is improved. This results in shorter cleaning times as well as a better cleaning result and, therefore, finally, to a higher quality of the thread. A better cleaning result means, in turn, that more time is allowed to pass until the next cleaning and, therefore, the next stoppage of the winding station can take place at a later point in time. Therefore, overall, the productivity of the textile machine is also increased.

Advantageously, the cover unit is rotated and/or linearly displaced with respect to the base unit from the working position into the cleaning position and back. These motions are easily carried out, and are robust and fast. In particular, these motions can also be carried out very well automatically. It is also possible to completely remove the cover unit from the working position, for example, by loosening screws, and to bring the cover unit back into this working position and secure it by tightening the screws.

It is also advantageous when vacuum is applied to a suction nozzle assigned to the thread seeking device in order to seek the thread end. The reason therefor is that using vacuum to seek the thread end is particularly gentle, since the surface of the cross-wound bobbin is not directly touched in this case and, therefore, the thread on the surface of the cross-wound bobbin is not damaged. Thus, a high level of quality of the produced thread is achieved.

It is advantageous when a suction port assigned to the suction nozzle is moved, in particular, rotated and/or linearly displaced with respect to the suction nozzle into the proximity of the surface of the cross-wound bobbin in order to seek the thread end. In this way, the distance of the suction port to the surface of the cross-wound bobbin can be adapted in a simple but highly effective way. In particular, a rotational and/or linear displacement motion can also be easily automated. The movement of only the suction port as compared to the entire suction nozzle also has the advantage that only one lightweight part must be moved and less space is required for the movement.

Finally, it is advantageous when the cover unit is locked in its working position and/or cleaning position. This prevents an unintentional movement of the cover unit. In addition, the cover unit is then located in a defined position in each case, which is required for seeking the thread end as well as for cleaning with the aid of a cleaning assembly. Overall, the operation of the winding station is therefore simplified and improved by way of the locking of the cover unit.

BRIEF DESCRIPTION OF THE DRAWINGS

Further advantages of the invention are described in the following exemplary embodiments. Wherein.

DETAILED DESCRIPTION

Figure 1A:
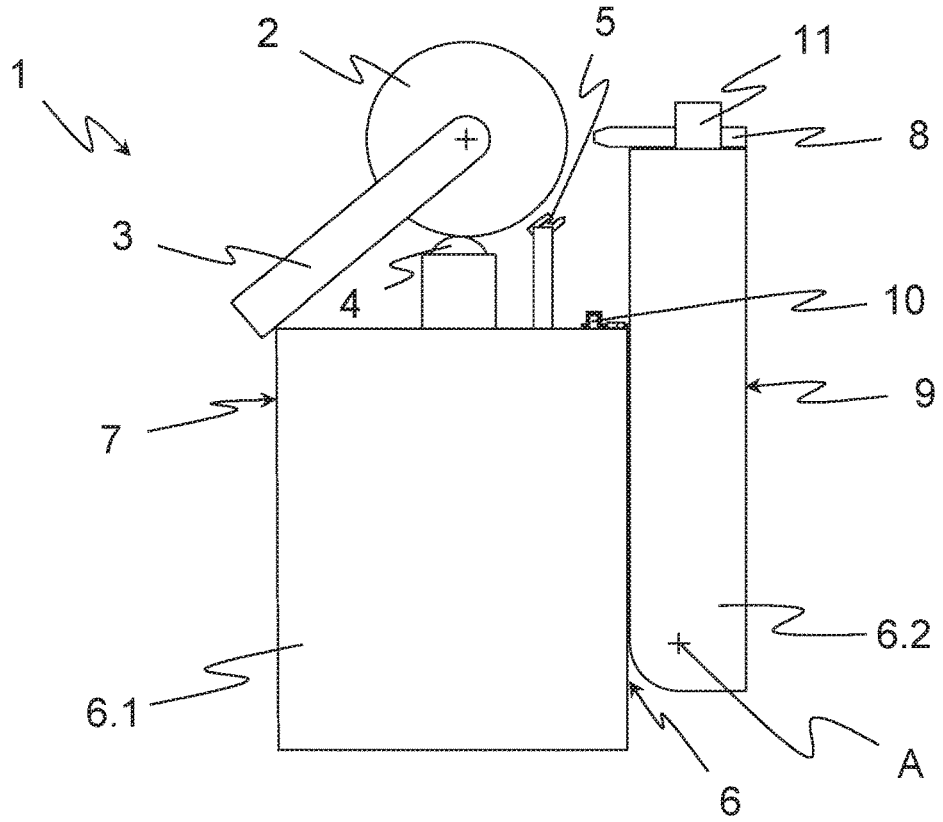
FIG. 1*a* shows a side view of a winding station.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1*a* shows a side view of a winding station 1 of a textile machine. The textile machine can be a winder or a spinning machine, in particular a ring spinning machine or an air-jet spinning machine. The winding station 1 winds thread coming from a supply bobbin or a spinning assembly onto a cross-wound bobbin 2. The cross-wound bobbin 2 is held by a bobbin holder 3 and is driven by a drive roller 4 in this case. The thread is laid in a crosswise manner on the cross-wound bobbin 2 by a traversing device 5, wherein the speed of the traversing movement is adapted to the rotational speed of the cross-wound bobbin 2.

The bobbin holder 3, the drive roller 4, the traversing device 5, and a first part 6.1 of a suction nozzle 6 form a base unit 7 of the winding station 1. A second part 6.2 of the suction nozzle 6 and a suction port 8 form a cover unit 9 of the winding station 1. The cover unit 9 can be rotated about an axis A with respect to the base unit 7 between a working position, which is shown here, and a cleaning position. The cover unit 9 can be locked in the working position with the aid of a locking means 10. Moreover, the suction port 8 can be linearly displaced with the aid of a motor 11, and so the suction port 8 can be brought into the proximity of the surface of the cross-wound bobbin 2. Due to the fact that only the relatively small suction port 8 and not the entire suction nozzle 6 needs to be displaced, the space required for the displacement is relatively small and, in addition, a small motor 11 is sufficiently powerful.

Figure 1B:
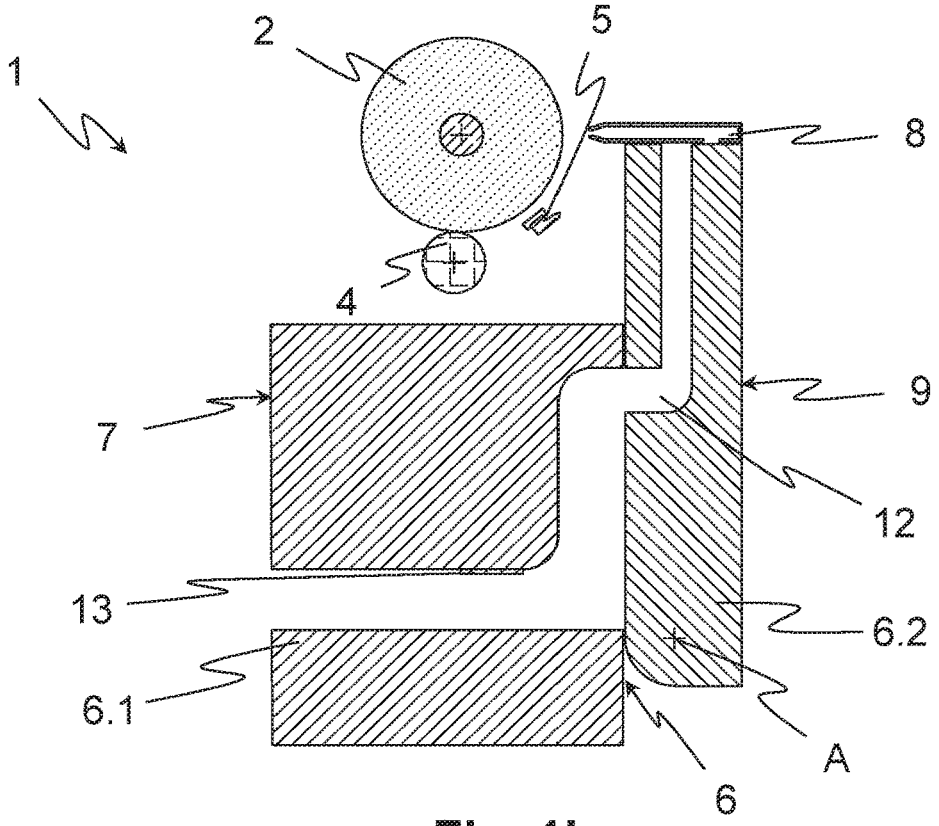
FIGS. 1*b*, 1*c*, and 1*d* show cross-sections of the winding station from FIG. 1*a;*

FIG. 1*b* shows a cross-section of the winding station 1 from FIG. 1*a*. The cover unit 9 is located in the working position again and the suction port 8 is remote from the cross-wound bobbin 2, and so a winding operation is possible without obstruction. An air duct 12 extends through both parts 6.1 and 6.2 of the suction nozzle 6. The suction port 8 closes the upper end of the air duct 12 in this case, and so no air is drawn in at the suction port 8, even when the vacuum is switched on.

Moreover, an interruption flap 13 is provided, which is connected to the cover unit 9 via a linkage (not shown). In the position shown here, the interruption flap 13 allows air to pass through the air duct 12 without obstruction.

Figure 1C:
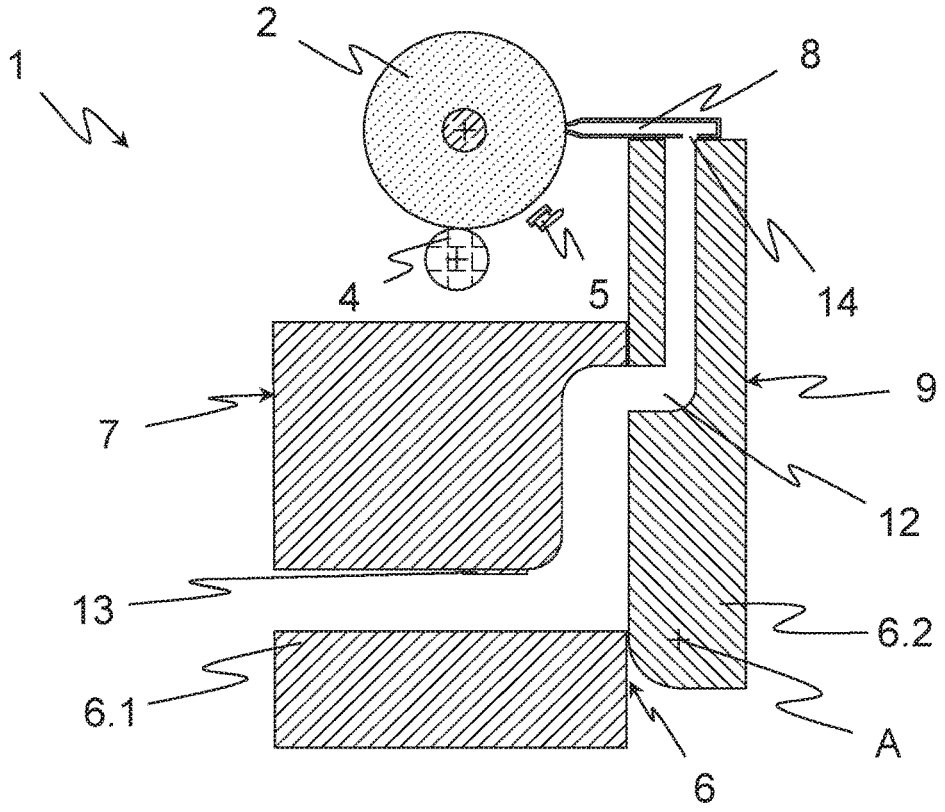

FIG. 1*c* shows the winding station 1 in the working position during the thread seeking process. The suction port 8 is located close to the surface of the cross-wound bobbin 2. The suction port 8 is now connected to the air duct 12 via an air opening 14, and so the vacuum advances up to the suction port 8. In order to now find the thread end on the surface of the cross-wound bobbin 2, the cross-wound bobbin 2 is slowly rotated in the direction opposite to the winding operation until the thread end is sucked in, via a suction opening of the suction port 8, into the suction port 8 and further into the air duct 12. The found thread end is then fed from the suction nozzle 6 and/or a thread catcher to further processing. This further processing can be, for example, the connecting to one further thread end or the piecing onto a spinning assembly. After conclusion of the further processing, the suction port 8 is then moved away from the cross-wound bobbin 2 again, and so the spinning operation can be continued without disruption.

Figure 1D:
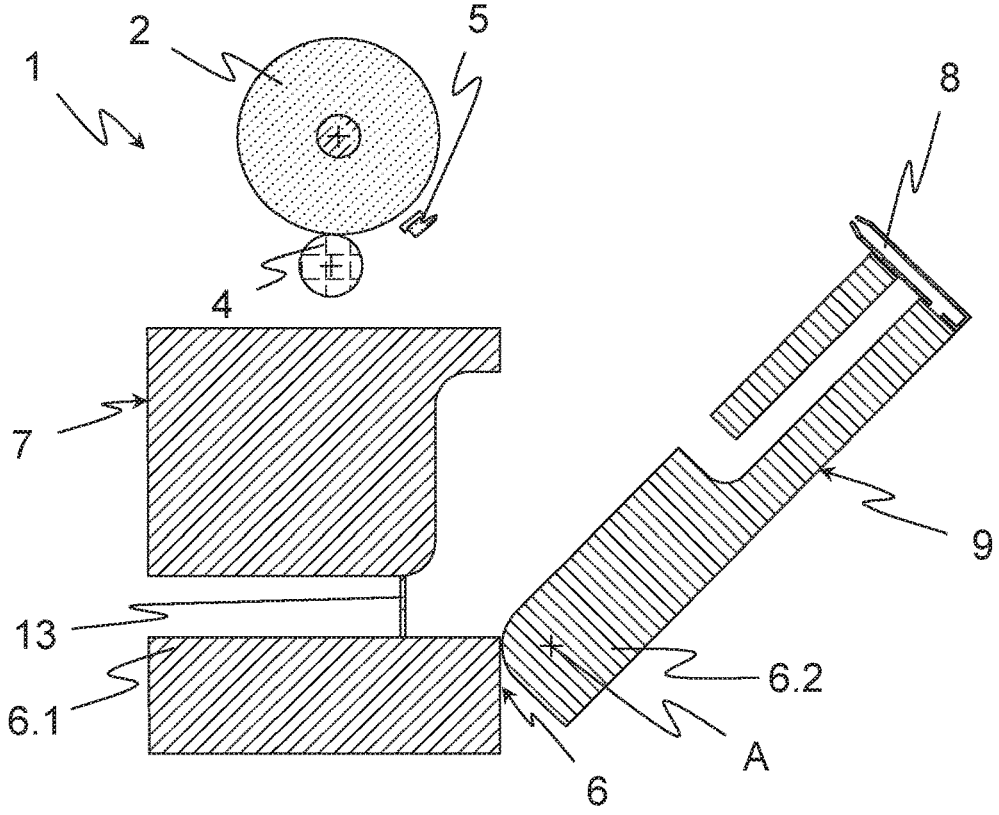

A cleaning of the winding station 1 is carried out, for example, after a predetermined time or when a sensor has established that pollution is present. For this purpose, the winding station 1 is brought into the cleaning position shown in FIG. 1*d*. The cover unit 9 has been rotated about the axis A with respect to the base unit 7. Due to this movement, the interruption flap 13 was also automatically closed, and so vacuum is not unnecessarily consumed. In this position, the suction nozzle 6 has now been divided into its two parts 6.1 and 6.2 and is more easily accessed. It can now also be cleaned from the inside. As a result, the cleaning can be carried out more easily and more thoroughly.

In the following description of the alternative exemplary embodiment represented in FIGS. 2*a* and 2*b*, identical reference signs are utilized for features which are identical and/or at least comparable in terms of their design and/or mode of operation as compared to the first exemplary embodiment represented in FIGS. 1*a* to 1*d*. Provided said alternative exemplary embodiments are not explained again in detail, their design and/or mode of operation correspond/corresponds to the design and mode of operation of the features already described above.

Figure 2A:
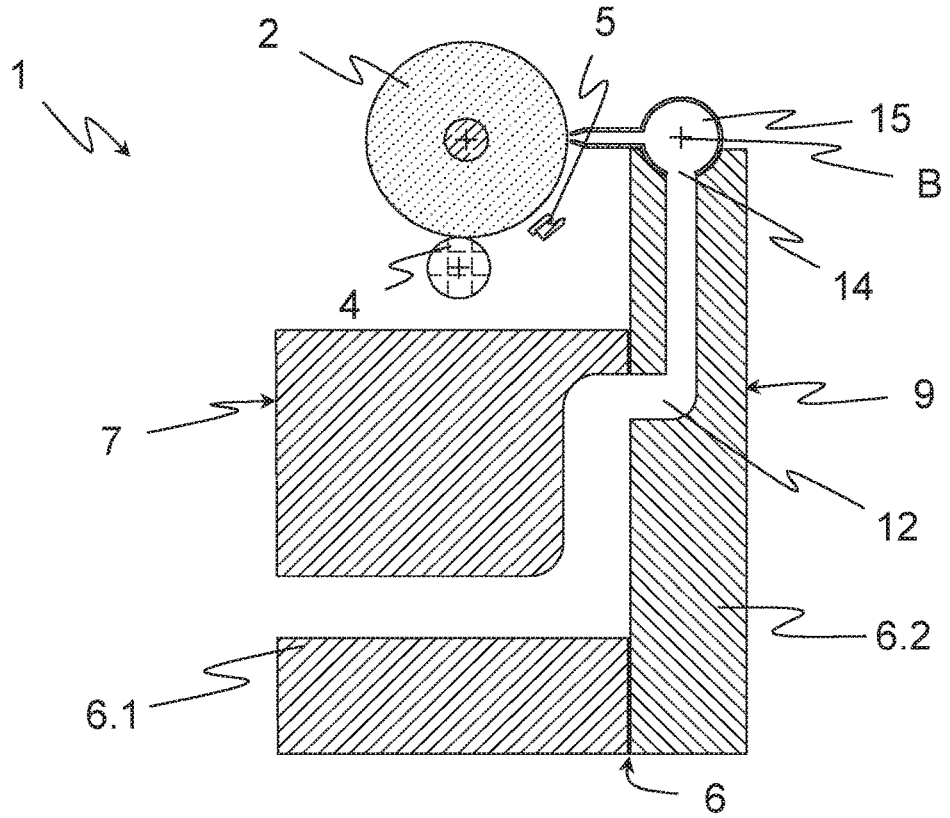
FIGS. 2*a* and 2*b* show cross-sections of one further winding station.

FIG. 2*a* shows a winding station 1 comprising a suction port 15 which is rotatable about an axis B. In this representation, the cover unit 9 is located in the working position and the suction port 15 is set up for thread seeking, and so a suction opening of the suction port 15 is located directly over the surface of the cross-wound bobbin 2. The air opening 14 establishes the connection of the suction port 15 to the air duct 12 again, and so vacuum reaches the suction port 15.

Figure 2B:
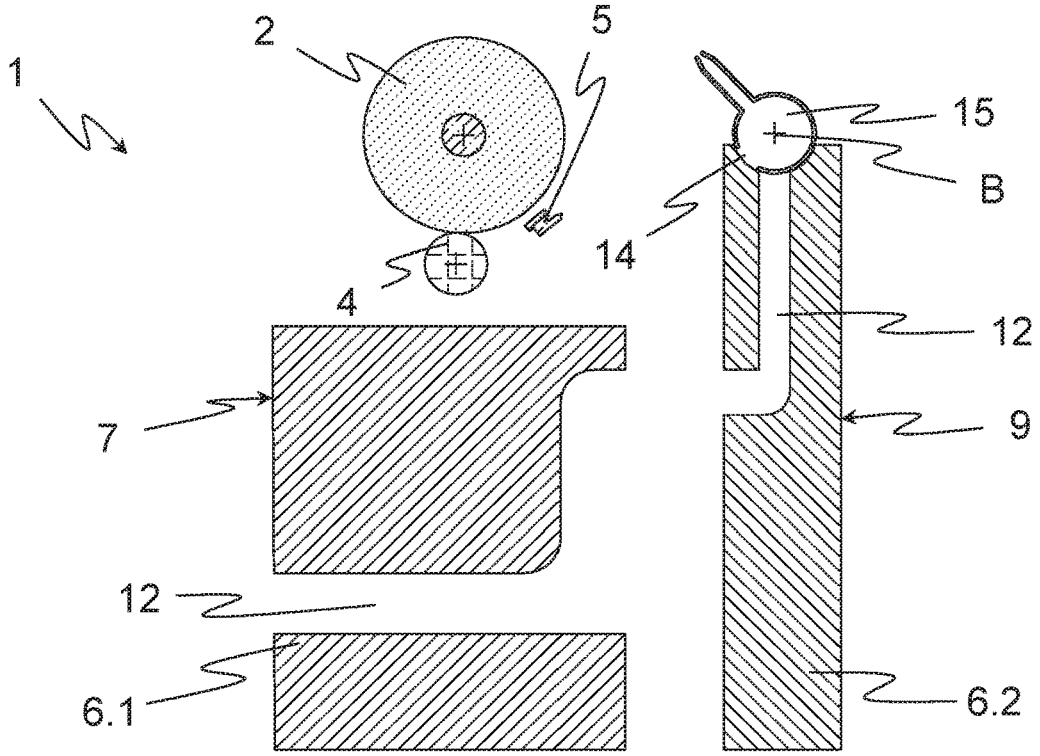

For cleaning, the cover unit 9 is moved into the cleaning position represented in FIG. 2*b*. For this purpose, the cover unit 9 is linearly displaced with respect to the base unit 7 in this exemplary embodiment. In this case as well, the suction nozzle 6 has now been divided into its two parts 6.1 and 6.2 and can be cleaned more easily, more thoroughly, and from the inside. The suction port 15 is located in a parked position, wherein the suction port 15 has been rotated about the axis B and, as a result, closes the air opening 14, similar to the case shown in FIG. 1*b*. In order to clean the air duct 12 and the suction port 15, the suction port 15 can also be rotated, as necessary, in the cleaning position of the cover unit 9 and, therefore, the air opening 14 can be opened.

Figure 3A:
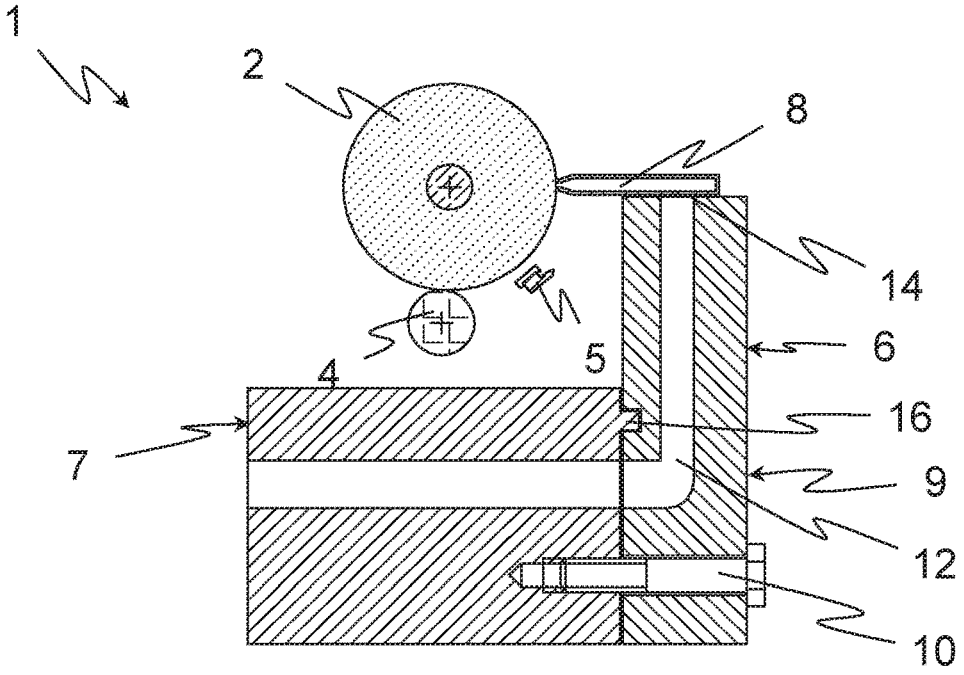
FIGS. 3*a* and 3*b* show cross-sections of one further winding station.
Figure 3B:
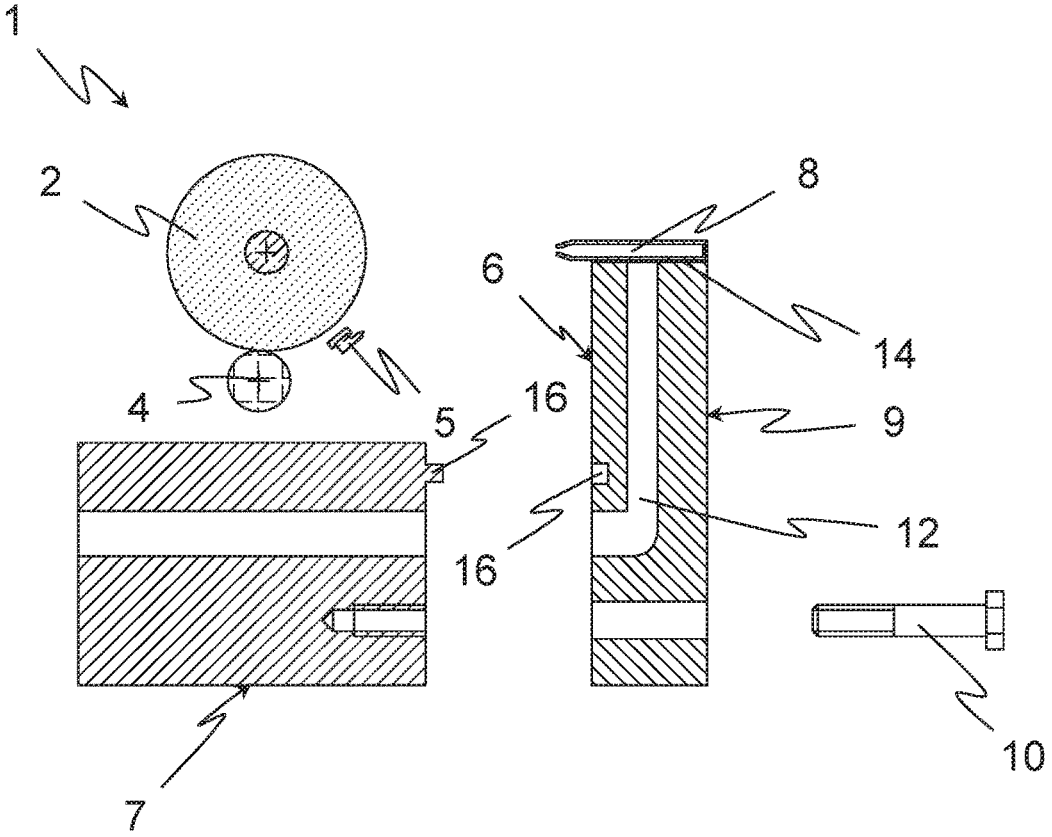

Finally, FIGS. 3*a* and 3*b* show cross-sections of one further winding station 1. The suction nozzle 6 is completely assigned to the cover unit 9 in this exemplary embodiment. The fastening of the cover unit 9 on the base unit 7 takes place with the aid of a locking means 10 designed as a screw. For the purpose of better positioning, adjusting means 16 are provided, which are designed as a pin assigned to the base unit and a recess assigned to the cover unit. Of course, the assignment of the pin and the recess can be the other way around and/or an additional screw can contribute to better positioning.

In FIG. 3*a*, the cover unit 9 is fastened to the base unit 7 and the winding station 1 is therefore located in the working position. In order to thoroughly clean the winding station 1, the locking means 10 are released and the cover unit 9 is moved away from the base unit 7. The cleaning position achieved in this way is shown in FIG. 3*b*. It is now possible to clean the air duct 12, for example, from both sides.

In order to then return to the working position, the cover unit 9 is placed onto the base unit 7 again. A precise positioning is achieved in this case with the aid of the adjusting means 16. The cover unit 9 is then fixedly fastened to the base unit 7 with the aid of the locking means 10. Thereupon, the winding operation can be started again.

The present invention is not limited to the exemplary embodiments which have been represented and described. Modifications within the scope of the claims are also possible, as is any combination of the features, even if they are represented and described in different exemplary embodiments.

LIST OF REFERENCE CHARACTERS

1 winding station
2 cross-wound bobbin
3 bobbin holder
4 drive roller
5 traversing device
6 suction nozzle
7 base unit
8 suction port
9 cover unit
10 locking means
11 motor
12 air duct
13 interruption flap
14 air opening
15 suction port
16 adjusting means
A axis
B axis

The invention claimed is:

1. A winding station of a textile machine for producing cross-wound bobbins, comprising:

a base unit;

a cover unit configured in a working position on the base unit in an operational state of the winding station where thread is being laid on the cross-wound bobbin;

a bobbin holder configured to hold the cross-wound bobbin;

a traversing device configured to lay the thread in a crosswise manner on the cross-wound bobbin;

a thread seeking device configured to find a thread end on the cross-wound bobbin;

wherein in the working position, the cover unit at least partially covers the base unit in the operational state of the winding station, and the cover unit is movable with respect to the base unit between the working position for laying the thread and seeking the thread end and a cleaning position for cleaning the winding station; and wherein at least portions of the thread seeking device are configured on the cover unit.

2. The winding station as in claim 1, wherein the cover unit is displaceable relative to the base unit between the working position and the cleaning position, or is removable from the working position on the base unit and placeable back into the working position on the base unit.

3. The winding station as in claim 1, wherein the thread seeking device comprises a suction nozzle, the suction nozzle comprising a suction port on.

4. The winding station as in claim 3, wherein the suction port is movable with respect to the suction nozzle.

5. The winding station as in claim 4, further comprising a drive configured to move the suction port with respect to the suction nozzle.

6. The winding station as in claim 4, wherein the suction port is rotatably or linearly displaceable relative to the suction nozzle.

7. The winding station as in claim 4, wherein the suction nozzle comprises a first portion part configured with the base unit and a second portion part configured with the cover unit.

8. The winding station as in claim 7, wherein the suction port is configured with the first portion part or with the second portion part of the suction nozzle.

9. The winding station as in claim 1, further comprising means for interrupting the vacuum in the cleaning position of the cover unit.

10. The winding station as in claim 1, further comprising a lock configured to lock the cover unit in the working position or the cleaning position.

11. A method for operating a winding station of a textile machine that produces cross-wound bobbins, the winding station having a base unit and a cover unit, the cover unit configured in a working position on the base unit in an operational state of the winding station when a thread is being laid on the cross-wound bobbin, the method comprising:

laying the thread in a crosswise manner on the cross-wound bobbin with the aid of a traversing device;

when necessary, seeking a thread end on the cross-wound bobbin with a thread seeking device;

cleaning the winding station at intervals of time; and wherein for the cleaning, the cover unit is moved with respect to the base unit out of the working position into a cleaning position, trash pollutant is removed from the winding station, and the cover unit is moved from the cleaning position back into the working position.

12. The method as in claim 11, wherein the cover unit is rotated or linearly displaced with respect to the base unit from the working position into the cleaning position and back, or is removed from the working position on the base unit and is brought back into the working position on the base unit.

13. The method as in claim 11, further comprising applying vacuum to a suction nozzle assigned to the thread seeking device to seek the thread end.

14. The method as in claim 13, wherein a suction port is configured with and displaceable with respect to the suction nozzle into proximity of a surface of the cross-wound bobbin in order to seek the thread end.

15. The method as in claim 11, further comprising locking the cover unit in the working position or the cleaning position.

* * * * *